US008141298B2

(12) United States Patent
Heroux

(10) Patent No.: US 8,141,298 B2
(45) **Date of Patent: *Mar. 27, 2012**

(54) REMOVABLE DRAFT BLOCKER HAVING AN END RETAINING ELEMENT

(75) Inventor: Steve G. Heroux, South Burlington, VT (US)

(73) Assignee: Hip Innovations, LLC, Williston, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/623,056

(22) Filed: Nov. 20, 2009

(65) Prior Publication Data

US 2011/0120023 A1 May 26, 2011

(51) Int. Cl.
*E06B 1/70* (2006.01)

(52) U.S. Cl. ..... 49/470; 292/343; 49/70; 49/469

(58) Field of Classification Search ..... 49/70, 469, 49/467, 470, 475.1, 482.1; 292/342, 343; 16/82; 160/40
See application file for complete search history.

(56) References Cited

U.S. PATENT DOCUMENTS

| | | | | |
|---|---|---|---|---|
| 712,240 | A | 10/1902 | Barnes et al. | |
| 1,336,527 | A | 4/1920 | Lewis | |
| 1,625,764 | A | 4/1927 | Bosley | |
| 1,783,305 | A * | 12/1930 | Olson | 49/482.1 |
| 1,883,609 | A | 10/1932 | Dennis | |
| 2,347,158 | A | 4/1944 | Spraragen | |
| 2,560,308 | A | 7/1951 | Spraragen | |
| 2,934,802 | A * | 5/1960 | Shekter | 49/493.1 |
| 3,968,597 | A * | 7/1976 | Hirtle | 49/477.1 |
| 4,034,511 | A | 7/1977 | Bursk | |
| 4,483,101 | A | 11/1984 | Berzina | |
| 4,639,027 | A | 1/1987 | Boyd | |
| 4,691,478 | A * | 9/1987 | Lorg | 49/499.1 |
| 4,765,094 | A * | 8/1988 | Gemmell | 49/475.1 |
| 4,959,927 | A * | 10/1990 | Atkinson | 49/475.1 |
| 5,475,946 | A | 12/1995 | Howe | |
| 5,475,948 | A * | 12/1995 | Parke | 49/506 |
| D371,600 | S * | 7/1996 | Henry | D23/386 |
| 5,794,871 | A | 8/1998 | Willetts | |
| 6,374,545 | B1 | 4/2002 | Baczuk | |
| 6,405,488 | B1 * | 6/2002 | Brown | 49/406 |
| 6,560,932 | B2 * | 5/2003 | Heroux | 49/469 |
| 7,401,439 | B2 * | 7/2008 | Heroux | 49/470 |
| 7,891,136 | B1 | 2/2011 | Heroux | |

(Continued)

FOREIGN PATENT DOCUMENTS

FR 2 787 825 A3 6/2000

(Continued)

*Primary Examiner* — Jerry Redman
(74) *Attorney, Agent, or Firm* — Bacon & Thomas, PLLC

(57) ABSTRACT

A removable draft blocker, for blocking drafts by sealing a gap between a bottom surface of a door and an underlying floor surface, includes first and second elongated draft blocking bodies, a base member extending between a bottom of the first draft blocking body and a bottom of the second draft blocking body to join the first and second draft blocking bodies in a spaced apart parallel relationship, and a retaining member disposed between ends of the first and second draft blocking bodies. The draft blocker is adapted to be positioned at the bottom of a door, with the draft blocking bodies on opposite sides of the door, and with the retaining member engaged behind or against a side edge of the door, such that the draft blocker is prevented from moving out of position as the door is opened and closed.

15 Claims, 8 Drawing Sheets

U.S. PATENT DOCUMENTS

| | | | |
|---|---|---|---|
| 2011/0030281 | A1 | 2/2011 | Vulpitta |

FOREIGN PATENT DOCUMENTS

| | | | |
|---|---|---|---|
| GB | 875 480 | | 8/1961 |
| GB | 1 079 667 | | 8/1967 |
| GB | 2 109 447 | A | 6/1983 |
| GB | 2 170 541 | A | 8/1985 |
| GB | 2 238 069 | A | 5/1989 |
| GB | 2 255 121 | A | 10/1992 |
| GB | 2 294 282 | A | 4/1996 |

* cited by examiner

REMOVABLE DRAFT BLOCKER HAVING AN END RETAINING ELEMENT

RELATED APPLICATIONS

The present application is related to U.S. application Ser. No. 12/854,663 (now U.S. Pat. No. 7,891,136) in that U.S. application Ser. No. 12/854,663 is a continuation of the present application.

FIELD OF THE INVENTION

The present invention relates to a seal device and, more particularly, to a removable draft exclude device for protecting against cold drafts or the like by creating a seal to close the gap between a door and its underlying floor, and including an end retaining element to hold the removable draft exclude in place.

BACKGROUND

Numerous devices have been devised to seal gaps in an architectural structure, such as threshold seals or draft blockers that block a gap between a movable architectural member such as a door, window, or the like, and an underlying or adjacent architectural structure such as a floor, window sill, or the like.

Various embodiments of draft blockers may be permanently installed, or temporarily positioned, to stop drafts from flowing through the gaps. In a permanent installation, a rubber or cloth weather stripping seal may be secured, using nails, screws, or other fastening methods that render the installation permanent, to the bottom edge of a door, and positioned so that an edge of the seal contacts the underlying floor to seal the gap between the bottom of the door and the floor.

Other devices are adapted for temporary placement. Exemplary are draft blockers generally in the form of an elongated bean-bag or the like that may be placed on a floor alongside and contacting the bottom edge of a door, thereby blocking a gap between the bottom of the door and the floor.

These temporarily placed draft blockers are advantageous in that they are relatively easy to retrofit in an architectural structure, and may be readily removed from one placement and relocated to other positions throughout the architectural structure. However, these devices, particularly when used to block a gap between the bottom of a door and the floor, are prone to sliding out of place during use, such as when the door is repeatedly opened and closed, resulting in the need to repeatedly replace the device in its proper position.

Accordingly, a draft blocker that is simple to position and effective in its use, including a means to retain the draft blocker in position, is desirable.

SUMMARY

According to one aspect of the present invention, there is provided a removable draft blocker for blocking a draft by sealing a gap between a bottom surface or edge of a door and an underlying floor surface. The draft blocker comprises first and second draft blocking bodies, each having a generally elongated configuration. A base member extends between a bottom of the first draft blocking body and a bottom of the second draft blocking body, such that the base member joins the first and second draft blocking bodies together in a parallel, spaced apart parallel relationship.

A retaining member is disposed at least one end of the draft blocker, and is configured to be engaged behind or against a side edge of the door to prevent movement of the removable draft blocker away from an installed position. The retaining member is, in certain embodiments, configured to extend between ends of the first and second draft blocking bodies, in the form of a strap or an end wall arranged to be positioned around or against a side edge of the door when the removable draft blocker is installed at the bottom of the door. In other embodiments, the retaining member is configured as a strap, a tab, or the like extending from the base member of the draft blocker.

BRIEF DESCRIPTION OF THE DRAWINGS

Similar reference characters denote corresponding features consistently throughout the attached drawings.

DETAILED DESCRIPTION OF VARIOUS EMBODIMENTS

Figure 1:
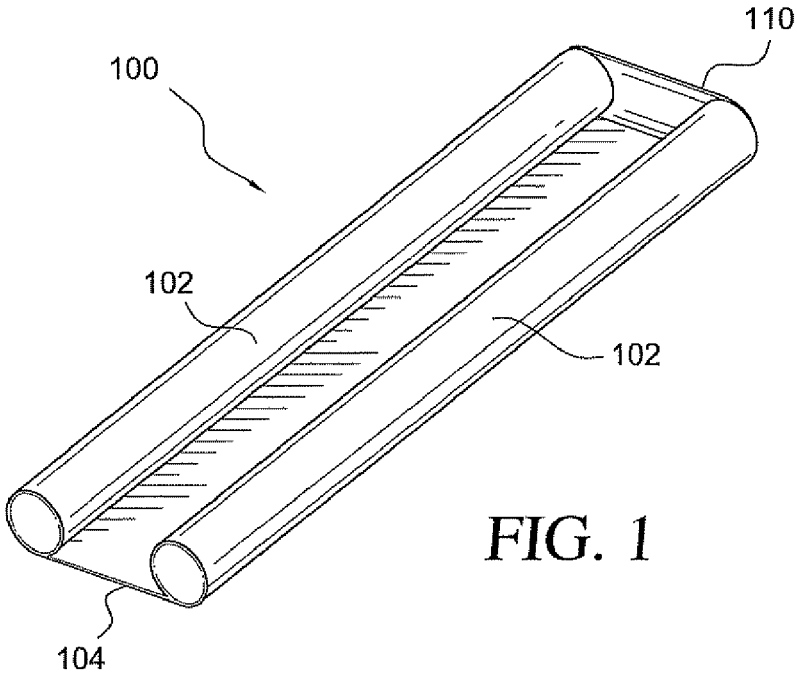
FIG. 1 is a perspective view of one embodiment draft blocker according to the present invention.
Figure 2:
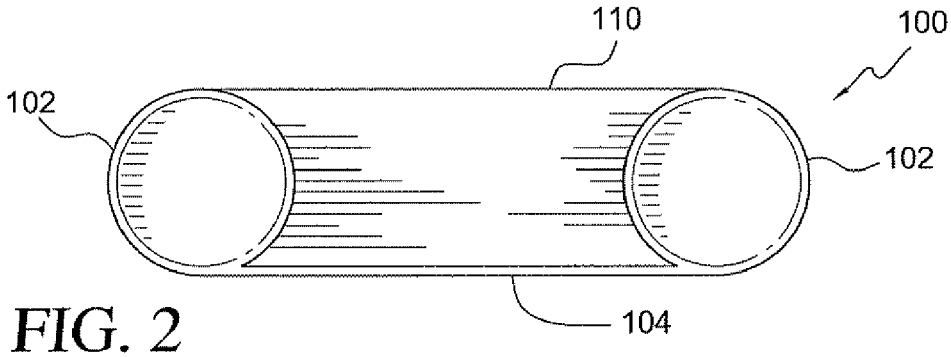
FIG. 2 is an end view of the draft blocker shown in FIG. 1.
Figure 3:
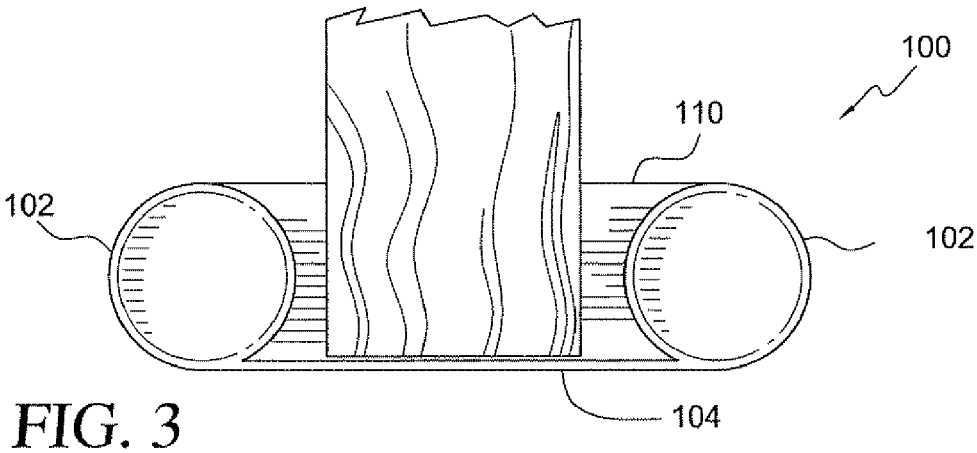
FIG. 3 is an end view of the draft blocker as shown in FIG. 2 positioned at the bottom of a door.

Referring to FIGS. 1-3, one embodiment of a removable draft blocker 100 for blocking drafts by sealing a gap between a bottom edge surface of a door and an underlying floor surface is shown. The draft blocker 100 comprises first and second draft blocking bodies 102 joined together by a base member 104. More particularly, the base member 104 extends between a bottom of the first draft blocking body 102 and a bottom of the second draft blocking body 102 to join the draft blocking bodies 102 together in a parallel, spaced apart relationship.

The draft blocking bodies 102 each comprise an elongated, and preferably flexible, body spanning substantially the length of a bottom edge of the door, with the base member 104 extending between the draft blocking bodies 102 and underneath the door.

A retaining member 110 is disposed at an end of the draft blocker 100, between ends of the draft blocking bodies 102, and is positioned to be engaged behind or against a side edge (preferably the hinge-side edge) of the door, such that the draft blocker 100 is prevented from moving out of position as the door is opened and closed. That is, the retaining member 110 prevents movement of the removable draft blocker 100 away from an installed position wherein the draft blocking bodies 102 lie on opposing sides of the bottom edge of the door with the base member 104 extending underneath the door.

The retaining member 110 may be formed as a strap extended between the draft blocking bodies 102, preferably extending between upper parts of the draft blocking bodies 102, or an end wall as shown. In the illustrated embodiment, the end wall extends from the base member 104 upward to an upper part of the draft blocking bodies 102, and may extend upward to the top of the draft blocking bodies. It can be recognized that a height of the retaining member (such as the vertical extent of the end wall) should be sufficient for the retaining member 110 to be engaged behind or against the side edge of the door.

Figure 4A:
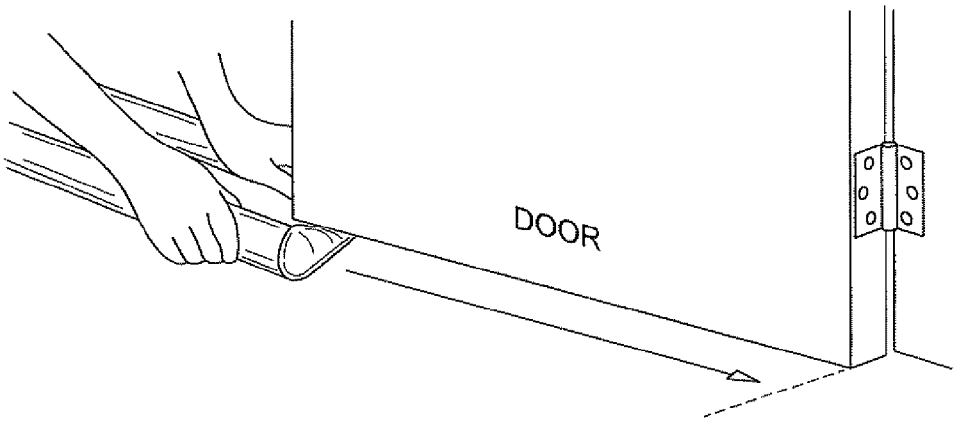
FIG. 4*a* illustrates a first step of installing a draft blocker with an end retaining member.
Figure 4B:
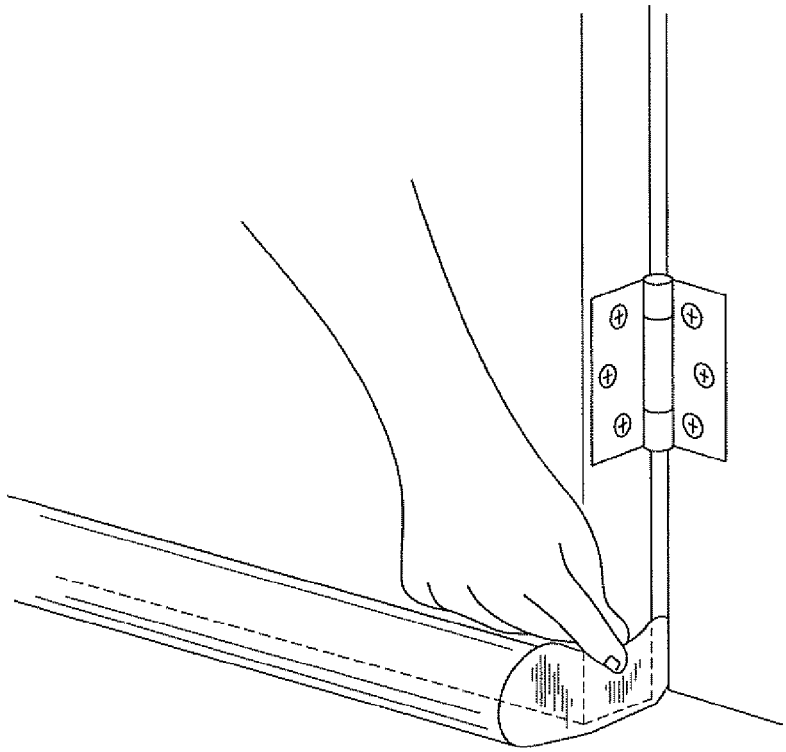
FIG. 4*b* illustrates a second step of installing a draft blocker with an end retaining member.

Preferably, the retaining member 110 is formed of a material with a flexible or elastic property such that the retaining member 110 may be pressed or displaced downward for clearance beneath the door's bottom edge for installation of the draft blocker 100. For example, referring to FIGS. 4*a* and 4*b*, the draft blocker 100 may be installed at the bottom of a door by sliding the draft blocker 100 lengthwise into position with one of the draft blocking bodies 102 on each side of the door, and the base member 104 underneath the door. It can be recognized that an elastic or deformable retaining member 110 can be passed underneath the door edge for installation, and then restored to a position engaged behind or against the door's side edge once the draft blocker 100 is fully positioned, to retain the draft blocker 100 in place.

Alternatively, the retaining member 110 may be formed of a rigid material, and attached to a flexible or elastic portion of the draft blocker 100, or may be removable and replaceable to accommodate installation.

Figure 5:
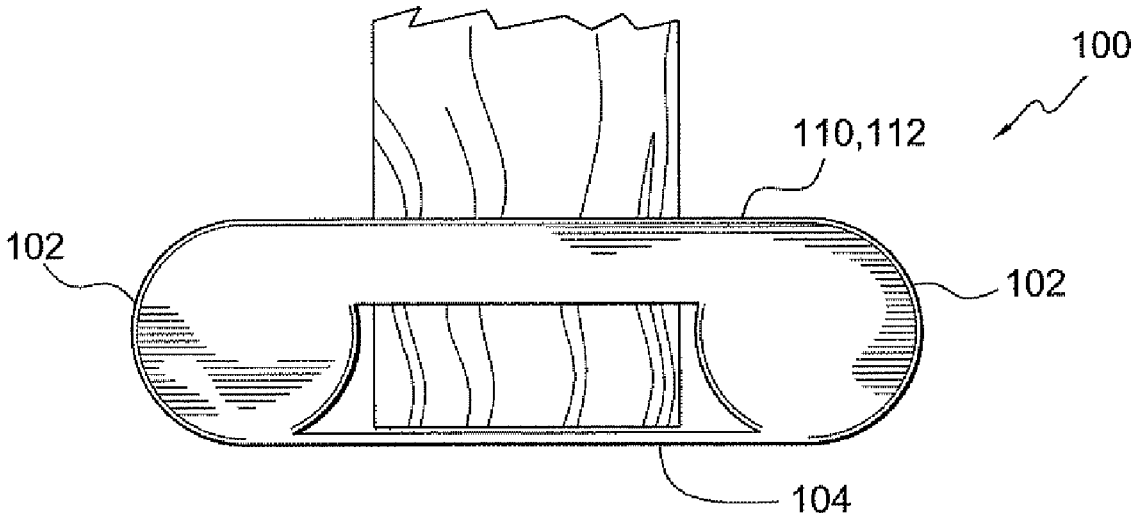
FIG. 5 is an end view of another embodiment of a retaining member for a draft blocker according to the present invention.

Referring to FIG. 5, the retaining member 110 may be provided as a strap 112 extending between the draft blocking bodies 102. A single piece strap 112 may be fixed at each end to the draft blocking bodies 102, or removably attached with a fastener such as a hook-and-loop type fastener (Velcro™, for example). Similarly, a two-piece strap may comprising two strap members each having a first end attached to one of the draft blocking bodies 102, and a second end having a fastener (such as a hook-and-loop type fastener) such that the two strap members can be can be separated for installation, and then joined together behind or against the door's edge once the draft blocker 100 is in place.

Figure 6:
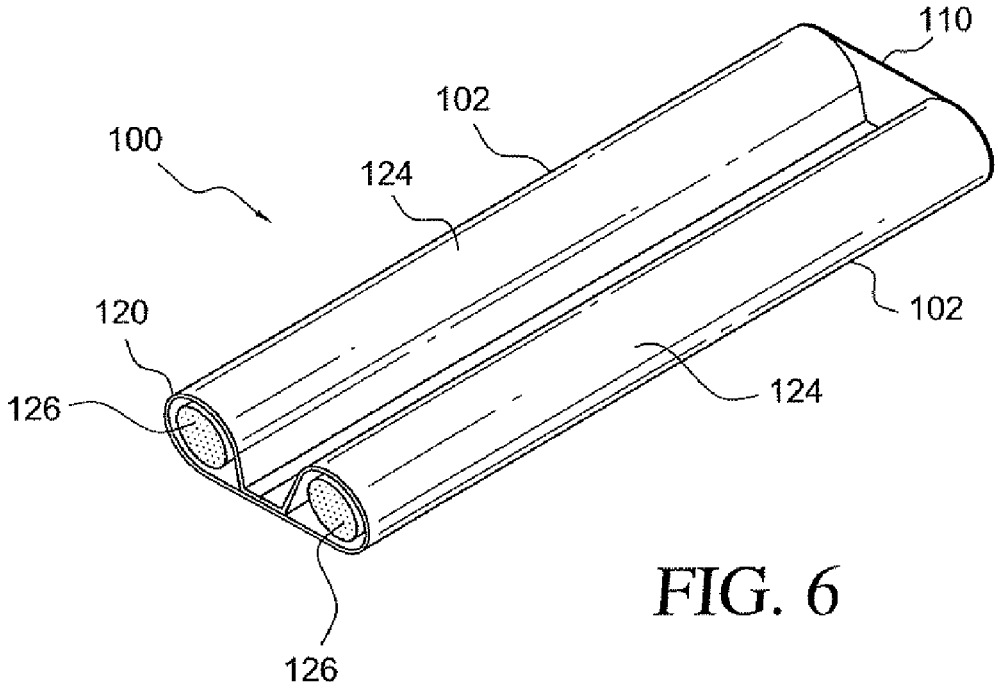
FIG. 6 is a perspective view of another embodiment of a draft blocker according to the present invention.
Figure 7:
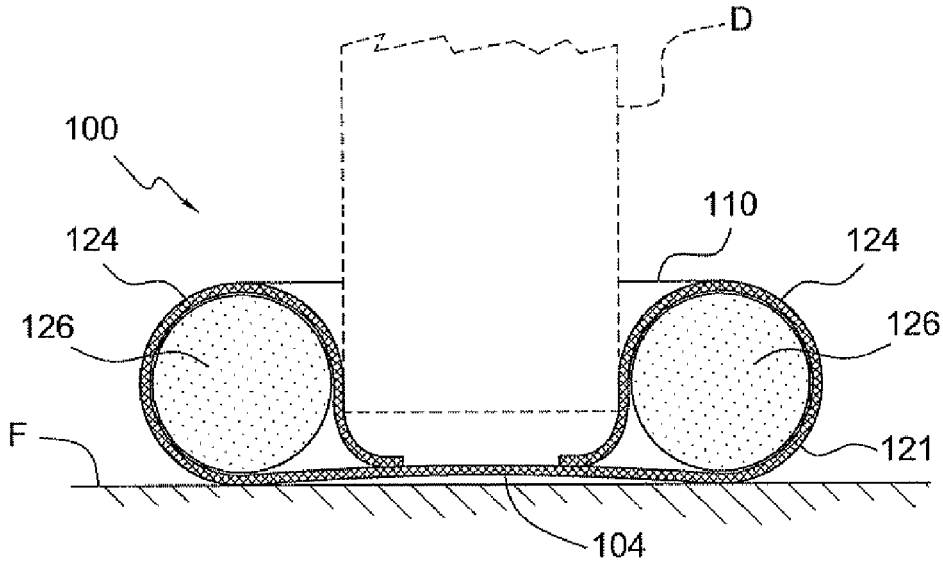
FIG. 7 is an end view of the draft blocker as shown in FIG. 6 positioned at the bottom of a door.

Turning to FIGS. 6 and 7, one embodiment of a removable draft blocker 100 comprises an elongated flexible body 120, configured for substantially wrapping around the bottom edge of the door. The body 120 has a base member 122 that longitudinally extends through the gap G and joins two generally elongated sleeves 124 integrally and laterally extending along the base member 104 in a generally parallel and spaced apart relationship relative to each other. An insulating material is provided in each of the elongated sleeves 124.

In the illustrated embodiment, the insulating material comprises two blocking members 126 which are disposed within respective sleeves 124. The sleeves 124 and blocking members 126 define draft blocking bodies 102 having a length and a cross-section perimeter to generally continuously close off the gap G along respective edges of the door bottom surface E all along its length.

In one configuration, the sleeves 124 have one end which is open, and closable by a closure flap 132 of the elongated flexible body 120, such that the draft blocking members 126 may be removably inserted into the sleeves 124. An embodiment of an elongated flexible body 120 wherein the sleeves 124 have openable and closable ends for insertion of the blocking members 126 is described in U.S. Pat. No. 6,560,932, which is hereby incorporated by reference in its entirety.

Figure 8:
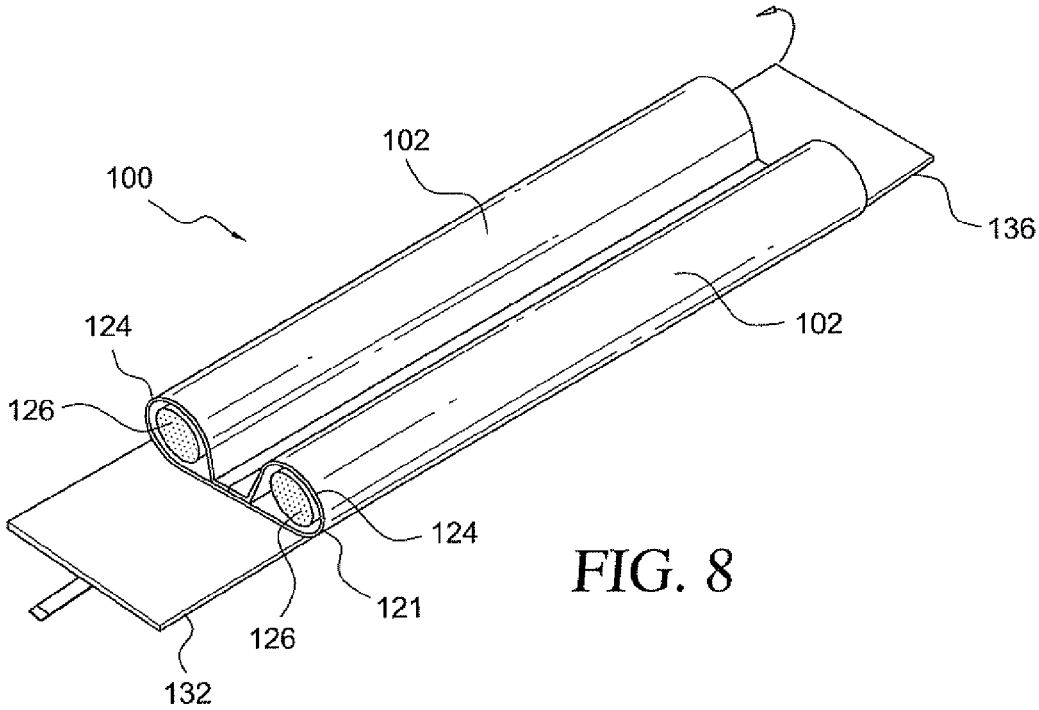
FIG. 8 is a perspective view of a draft blocker of FIG. 6 including an end closure flap and an end wall retaining member formed integrally with a cover element.

A retaining member 110 extends across an end of the flexible body 120, between the sleeves 124, at an upper part of the sleeves 124, to form an end wall configured to wrap around a side edge of the door. The retaining member 110 may be formed at a closed end of the flexible body 120 opposite the openable end. The retaining member 110 may be formed integrally with the flexible body 120. For example, referring to FIG. 8, in an embodiment wherein the flexible body 120 is formed from a fabric sheet 121, the retaining member 110 may be formed by providing an end flap 134 in the fabric sheet 121, and folding the end flap 134 upward against ends of the sleeves 124, and fastening the flap 134 in place by stitching or an adhesive to form a retaining member 110 fixed in place.

Figure 10:
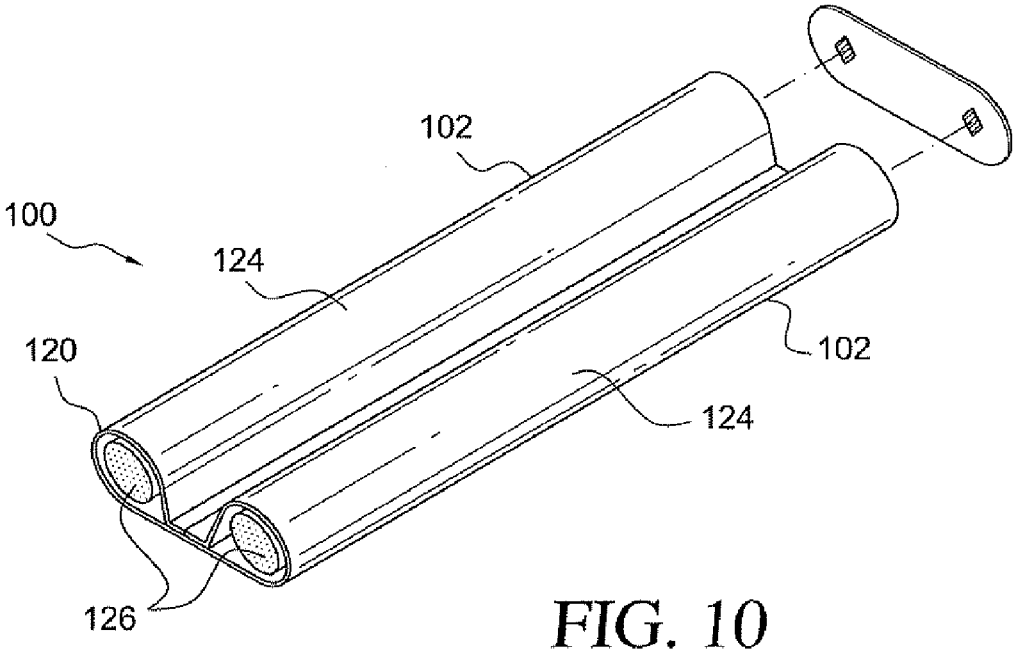
FIG. 10 is a partial perspective view of a draft blocker showing an alternative embodiment of a retaining member.
Figure 11:
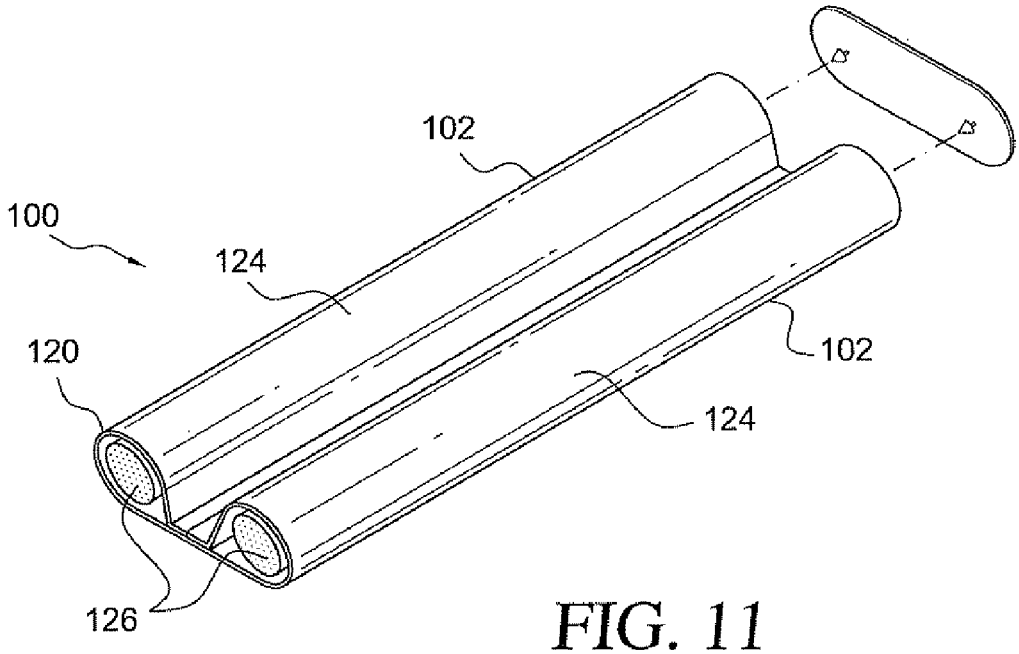
FIG. 11 is a partial perspective view of a draft blocker showing an alternative embodiment of a retaining member.

Alternatively, referring to FIGS. 10 and 11, the retaining member 110 may be formed separately from the flexible body 120, and permanently or removably attached. For example, a retaining member 110 may be provided in the form of an elastic material strip or band extending between the sleeves 124, wherein the elastic material strip is permanently fixed to ends of the sleeves by stitching, an adhesive, or the like, or removably attached to the ends of the sleeves by a hook-and-loop type fastener (Velcro™, for example), buttons or snaps, or the like. In the example shown in FIG. 11, fastening pins or tacks are fixed to the retaining member 110 and may include barb elements, such that the retaining member 110 is fixed to the draft blocking bodies 102 by inserting the fastening pins or tacks into the draft blocking body ends.

Figure 12:
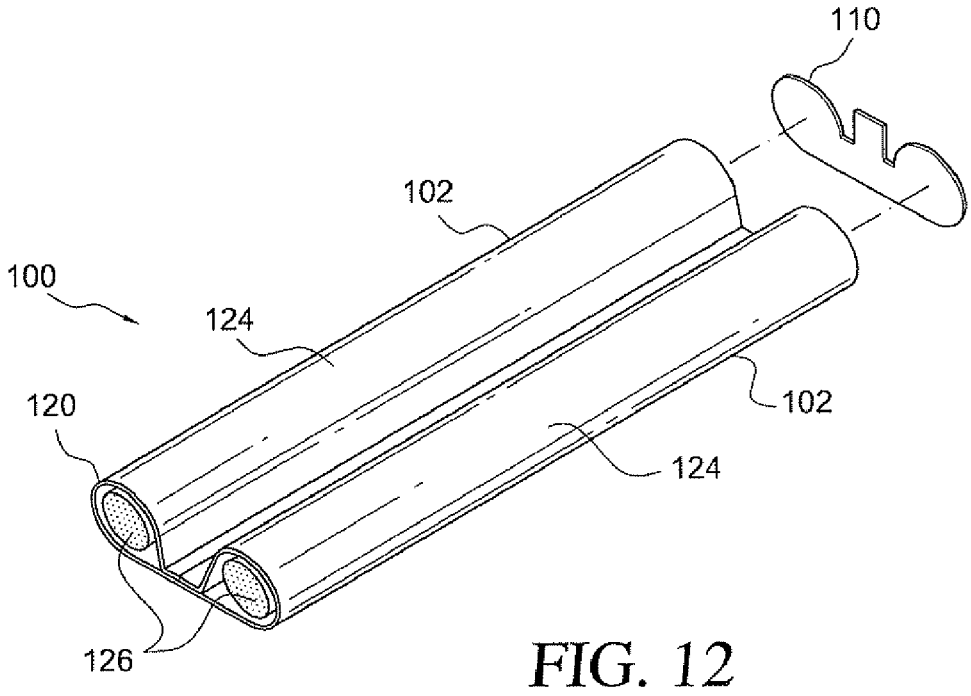
FIG. 12 is a partial perspective view of a draft blocker showing a further embodiment of a retaining member.
Figure 13:
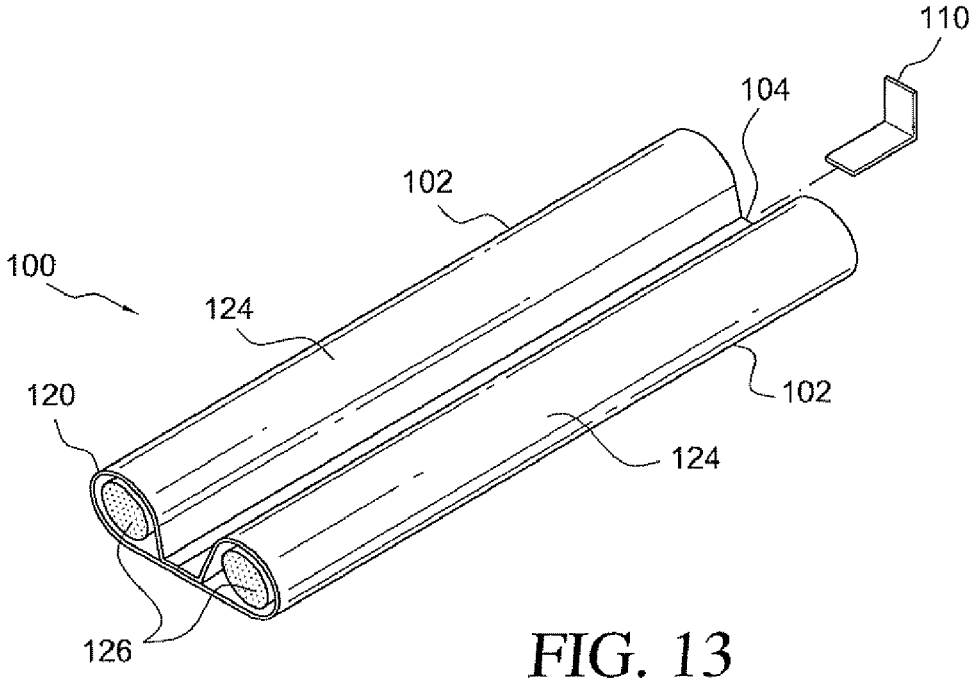
FIG. 13 is a partial perspective view of a draft blocker showing a still further embodiment of a retaining member.
Figure 14:
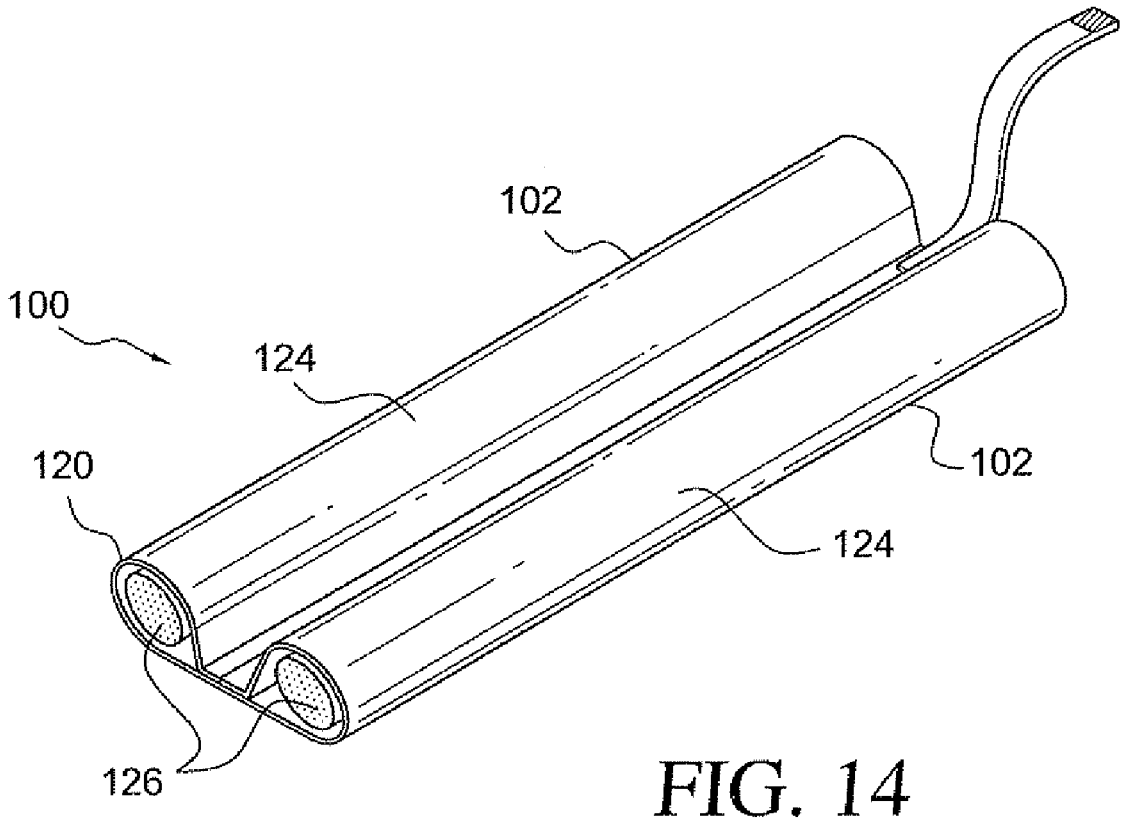
FIG. 14 is a partial perspective view of a draft blocker showing yet another embodiment of a retaining member.

A further configuration of a retaining member 110 is shown in FIG. 12, wherein a retaining member 110 is formed in a rigid plate, and comprises end parts configured for attachment abutted against ends of the draft blocking members 126, and an upwardly extending tab disposed between the end parts. In still a further configuration, shown in FIG. 13, a retaining member 110 is provided in the form of a tab extending upwardly from the base member 104. In such an embodiment, the retaining member 110 may be in the form of a right-angle bracket having a bottom part fastened to the base member 104, from which the tab extends vertically upward.

In yet another configuration, a retaining member 110 is provided as a strap extending from the base member 104 or another part of the draft blocker, having a hook-and-loop type fastener, snap, or other removably engageable fastening element disposed on a free end of the strap and configured to be engaged with a cooperating fastening element disposed on the door. Preferably, the cooperating fastening element is disposed on a side edge of the door near the bottom of the door.

Figure 9:
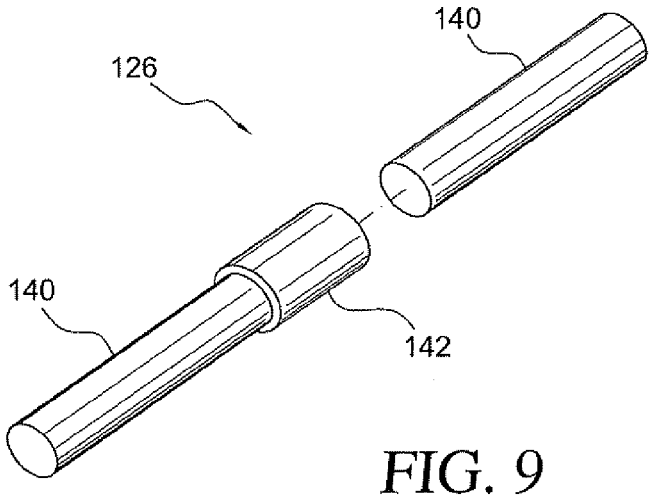
FIG. 9 is a perspective view of an alternative arrangement of a draft blocking member.

The draft blocking members 126 may be provided in several forms, such as lengths of foam type insulators or the like. In one embodiment, the draft blocking members 126 are each formed in two, or more, segments which may be removably joined together, as shown in FIG. 9. For example, two segments 140 may be joined by a coupling sleeve 142. Such an arrangement allows for more compact packaging and storage of the draft blocker 100.

Alternative to the draft blocking members 126, the sleeves 124 may be filled with loose insulating materials such as foam rubber, particulate polystyrene foam, beans, sand, fibrous materials, and the like.

It will be understood that the above-described embodiments of the invention are illustrative in nature, and that modifications thereof may occur to those skilled in the art. Accordingly, this invention is not to be regarded as limited to the embodiments disclosed herein, but is to be limited only as defined in the appended claims.

I claim:

1. A removable draft blocker for blocking drafts by sealing a gap between a bottom surface of a door and an underlying floor surface, said draft blocker comprising:

first and second elongated draft blocking bodies, each having a generally elongated configuration;

a base member extending between a bottom of said first draft blocking body and a bottom of said second draft blocking body, the base member joining said first and second draft blocking bodies in a spaced apart parallel relationship; and a retaining member disposed proximate to one end of said base member and between ends of said first and second draft blocking bodies;

wherein said base member is configured for placement underneath a bottom edge of a door with said first and second elongated draft blocking bodies disposed on opposite sides of the door, the retaining member being configured to be engaged behind or against a vertical side edge of the door whereby the base member is restrained from lengthwise movement in at least one direction along the bottom edge of the door.

2. The removable draft blocker according to claim 1, wherein said retaining member comprises a strap extending between said first draft blocking body and said second draft blocking body.

3. The removable draft blocker according to claim 2, wherein said strap comprises first and second strap members each having a first end attached to a respective one of the first and second draft blocking bodies, and a second end having a fastener for joining the strap members.

4. The removable draft blocker according to claim 1, wherein at least an upper edge of said strap extends between an upper part of said first draft blocking body and an upper part of said second draft blocking body.

5. The removable draft blocker according to claim 1, wherein said retaining member defines an end wall of a channel between said first and second draft blocking bodies.

6. The removable draft blocker according to claim 5, wherein said end wall extends from said base member to a top edge, the top edge extending between an upper part of said first draft blocking body and an upper part of said second draft blocking body.

7. A removable draft blocker for blocking drafts by sealing a gap between a bottom surface of a door and an underlying floor surface, said door having a bottom edge generally facing said underlying floor surface and at least one vertical side edge, said draft blocker comprising:

an elongated flexible body having first and second elongated sleeves and a base member extending between the first and second elongated sleeves, the base member joining the first and second elongated sleeves in a spaced apart parallel relationship;

a draft blocking member removably disposed in each said elongated sleeve; and a retaining member disposed at an end of said elongated flexible body and extending between ends of said first and second elongated sleeves and configured to be engaged behind or against a vertical side edge of the door whereby the elongated flexible body is restrained from lengthwise movement in at least one direction.

8. The removable draft blocker according to claim 7, wherein said retaining member defines an end wall of a channel between said first and second elongated sleeves when said draft blocking members are disposed in said sleeves.

9. The removable draft blocker according to claim 7, wherein said elongated flexible body is formed of a fabric sheet.

10. The removable draft blocker according to claim 7, wherein said elongated flexible body has a first end wherein said sleeves are closed, and a second end including a closure flap for selectively opening and closing said sleeves, wherein said first end defines said retaining member as an end wall of a channel between said first and second elongated sleeves when said draft blocking members are disposed in said sleeves.

11. The removable draft blocker according to claim 10, wherein said end wall extends upward from said base member.

12. The removable draft blocker according to claim 10, wherein said end wall extends upward to a top edge.

13. A removable draft blocker for blocking drafts by sealing a gap between a bottom surface of a door and an underlying floor surface, said draft blocker comprising:

first and second elongated draft blocking bodies, each having a generally elongated configuration;

a base member extending between a bottom of said first draft blocking body and a bottom of said second draft blocking body, the base member joining said first and second draft blocking bodies in a spaced apart parallel relationship; and a retaining means disposed proximate to an end of said first and second draft blocking bodies or said base member to engage with a vertical edge of the door to prevent movement of the removable draft blocker away from an installed position.

14. The removable draft blocker according to claim 13, wherein said retaining means is fixed to said base member.

15. The removable draft blocker according to claim 13, wherein said retaining means is fixed between said first and second elongated draft blocking bodies.

* * * * *